United States Patent [19]

Kusano et al.

[11] Patent Number: 4,742,272

[45] Date of Patent: May 3, 1988

[54] MAGNETRON

[75] Inventors: Jiro Kusano, Yokohama; Akikazu Harada; Seiji Kitakaze, both of Mobara, all of Japan

[73] Assignees: Hitachi, Ltd.; Hitachi Device Eng. Co., Ltd., both of Tokyo, Japan

[21] Appl. No.: 12,993

[22] Filed: Feb. 10, 1987

[30] Foreign Application Priority Data

Mar. 26, 1986 [JP] Japan ..... 61-65762

[51] Int. Cl.[4] ..... H01J 23/22

[52] U.S. Cl. ..... 315/39.69; 315/39.53; 315/39.71

[58] Field of Search ..... 315/39.69, 39.51, 39.53, 315/39.75, 39.73

[56] References Cited

U.S. PATENT DOCUMENTS

| | | | |
|---|---|---|---|
| 3,176,188 | 3/1965 | Wilbur | 315/39.69 |
| 4,074,169 | 2/1978 | Harada | 315/39.75 X |
| 4,288,721 | 9/1981 | Dodonov | 315/39.51 |
| 4,300,072 | 4/1981 | Tashiro | 315/39.51 |
| 4,459,563 | 7/1984 | Kawaguchi | 315/39.53 X |
| 4,644,225 | 2/1987 | Aiga et al. | 315/39.51 |

FOREIGN PATENT DOCUMENTS

| | | | |
|---|---|---|---|
| 54-125564 | 1/1979 | Japan | 315/39.5 |

*Primary Examiner*—David K. Moore
*Assistant Examiner*—Mark R. Powell
*Attorney, Agent, or Firm*—Antonelli, Terry & Wands

[57] ABSTRACT

A magnetron includes inner and outer strap rings for providing a linkage among vanes which are disposed inside of an anode cylinder. The inner and outer strap rings have their diameters determined such that their algebraic mean is 1.75–1.95 times the diameter of an interaction space defined by the inner tips of the vanes. The magnetron structure achieves a significant leakage supression effect against spurious microwaves, particularly the fifth harmonic.

13 Claims, 6 Drawing Sheets

MAGNETRON

BACKGROUND OF THE INVENTION

This invention relates to a microwave cooker or oven and, particularly, to a magnetron having a means for reducing the emission or leakage of spurious electromagnetic waves, e.g., the fifth harmonic, included in the oscillated output power.

Microwave cookers use the microwave of 2.45 GHz band for heating and cooking food, and a magnetron which is generally used for this also produces harmonics in addition to the 2.45 GHz fundamental wave. A project of television broadcasting (ABD) in which television programs are directly transmitted to television sets in general households using a broadcast satellite is now under way (and in Japan such has been already practiced), and it is expected to use a 11.7–12.7 GHz band. Therefore, microwave cookers are requested to reduce the leakage of harmonic components, particularly the fifth harmonic component (12.25 GHz), in order to prevent interference to the satellite broadcasting. Some conventional microwave cookers are known to have a microwave absorber made of ferritte or soft ferrite provided at the door. However, such ferrite absorber cannot satisfactorily reduce the harmonic components since the ferrite absorber itself is limited in performance and is very expensive and since the harmonic reduction is not tackled on the microwave sourcing magnetron.

FIG. 1 is a partial cross-sectional view of the conventional magnetron having a means for preventing spurious emission of microwave. In the figure, reference number 1 denotes an anode cylinder, which is provided in its interior room with a plurality of centripetal vanes 2, so that both members in combination constitutes a resonant cavity. A cathode (cathode filament) 10 is located at the center of the anode cylinder 1, and an interaction space is formed between the cathode 10 and the vanes 2. A magnetic pole piece 7 is fixed by soldering or arc welding hermetically to each end of the anode cylinder 1, and it serves to focus or concentrate the magnetic flux produced by an external magnet (not shown) to the interaction space. A stem 11 is to support the cathode 10, and it is fixed hermetically through the magnetic pole piece 7. An output choke 6 is disposed to prevent spurious emission of microwave, and it is welded or soldered to a metallic output sealing member 5 e.g., made of Fe, FeNi alloy or FeNiCo alloy. A ceramic cylinder 9 is secured hermetically to the magnetic pole piece 7 through the output sealing members 5 and 5' which are equipotential with the anode 1. An exhausting tube or pipe 12 made of copper or the like is secured hermetically to the upper end of the ceramic cylinder 9, and it also serves as an output antenna. An antenna lead wire 4 has its one end connected with one of the vanes 2 and another end passing through a hole 13 in the magnetic pole piece 7 and fixed to the exhausting tube 12, namely it is press-welded to the exhausting tube 12 when it is chipped off. A metallic cap 14 is put on the exhausting tube 12 for protecting the press-welded portion of the exhausting tube 12 and antenna lead wire 4. Strap rings 3 are fixed on the upper and lower ends of the vanes 2.

The foregoing structure of magnetron is described, for example, in Japanese Utility Model Laid-open Publication No. 54-125564. However, its output choke alone could not perfectly prevent the leakage of spurious microwave or harmonics. The above-mentioned publication does not clarify the relation between the dimensions of the choke for a specific spurious microwave, e.g., the inner diameter and length of the choke and their effect of leakage prevention. On this account, this prior art magnetron structure has not achieved satisfaction in leakage prevention against spurious microwave or harmonics.

SUMMARY OF THE INVENTION

An object of this invention is to provide a magnetron which is less in the leakage of spurious microwave or harmonics.

A more specific object of this invention is to provide a magnetron which has less spurious leakages, particularly the fifth harmonic.

According to one aspect of this invention, in order to achieve the above objectives, the inner strap ring and outer strap ring of the magnetron have their diameters determined basing on the relation between the algebraic mean of the inner and outer strap rings' diameters and the attenuation of spurious microwave to be prevented from leaking. More specifically, the algebraic mean of the inner and outer strap rings' diameters is made 1.75 to 1.95 times the diameter of the space defined by the tips of the vanes.

According to another aspect of this invention, the inner and outer strap rings of the magnetron have an algebraic mean of diameters made 1.75 to 1.95 times the vane's inner diameter, i.e., the diameter of the space defined by the tips of the vanes (hereinafter sometimes referred to as an interaction space diameter) and in addition a metallic cylindrical choke having approximately quarter the wavelength $\lambda$ of the spurious microwave or harmonic under leakage suppression is disposed on the inside and/or outside of the opening, which is more remote from the anode cylinder, of the sleeve-shaped metallic sealing member provided at the output side of the magnetron.

The above dimensional condition for the strap rings based on experiments has proved a significant reduction in leakage spurious microwave. The range of mean diameters "1.75 to 1.95 times the vane's inner diameter" is effective for the leakage suppression of the second to fifth harmonics.

DESCRIPTION OF THE PREFERRED EMBODIMENTS

Figure 1:
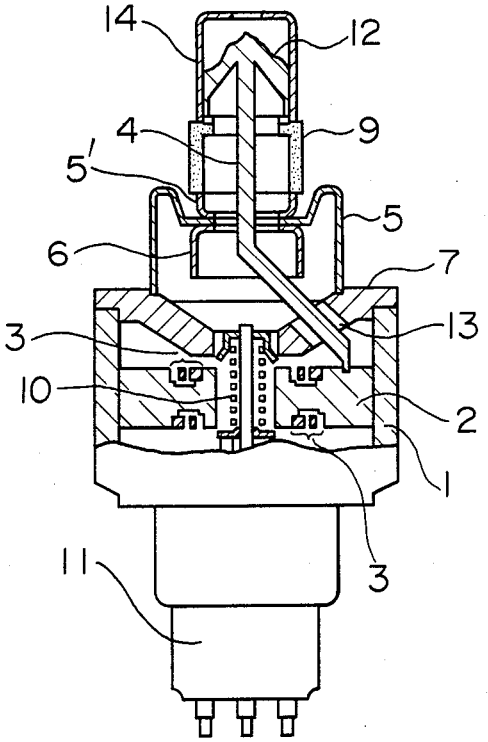
F I G. 1 PRIOR ART
FIG. 1 is a partial, longitudinal cross-section of the conventional magnetron.
Figure 2:
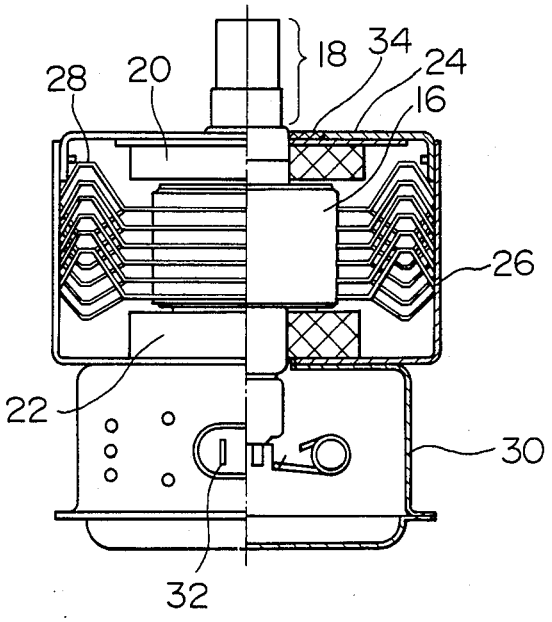
FIG. 2 is a diagram, partly in cross-section, showing in brief an example of magnetron to which this invention is applied.

First, an example of the structure of the magnetron to which the present invention is applied will be described in connection with FIG. 2. In the figure, a magnetron main body 16 incorporates therein an anode electrode having a plurality of cavity resonators, a cathode filament which emits thermal electrons, a pair of magnetic pole pieces for producing a parallel magnetic field which intersects at right angles with a d.c. electric field produced by the anode and cathode electrodes, an antenna lead in connection with the cavity resonators for the transmission of microwave energy, and an antenna 18 for emitting the microwave energy to the outside. Other components include permanent magnets 20 and 22 and yokes 24 and 26, all in combination forming a magnetic circuit to supply necessary magnetism to the magnetic pole pieces in the magnetron main body 16, a heat sink 28, a metallic casing 30 in the form of a shielding box for preventing the leakage of microwave from the cathode electrode, a filament lead out terminal 32, and a metallic gasket 34 surrounding the antenna 18.

Figure 3:
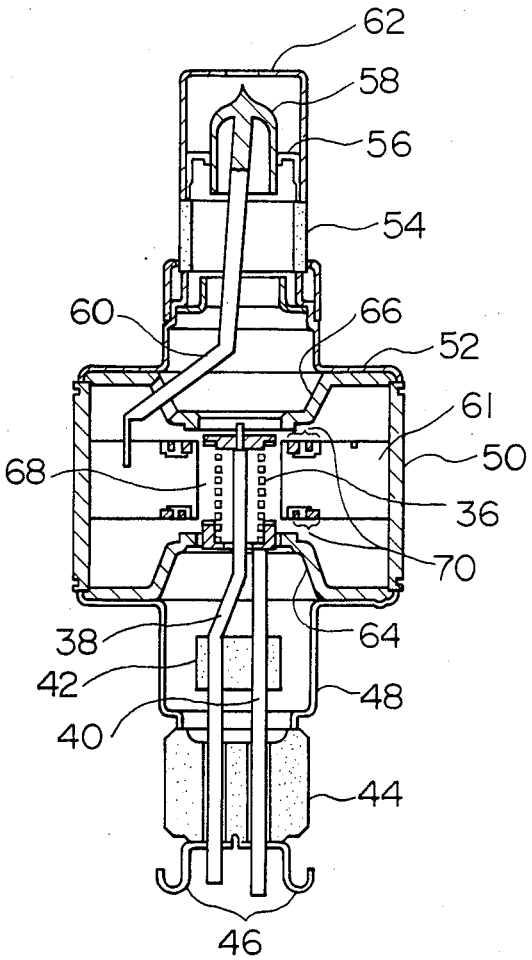
FIG. 3 is a longitudinal cross-section of the magnetron embodying the present invention.
Figure 6:
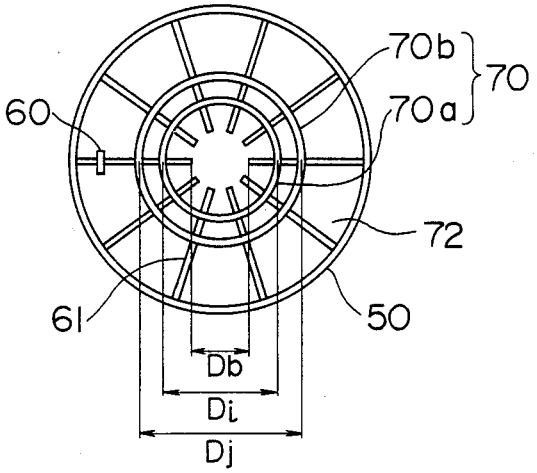
FIG. 6 is a cross-sectional view taken along the line I—I of FIG. 4.

Next, an embodiment of this invention will be described in connection with FIGS. 3, 4, 5 and 6. In FIG. 3, a cathode filament 36 is supported by metallic lead posts 38 and 40 and a ceramic spacer 42, and fixed to a cathode insulator 44. The cathode filament 36 is supplied with a current through a filament terminal 46, and emits thermal electrons. A metallic cathode sealing member 48 connects the end of an anode electrode 50 hermetically to the cathode insulator 44. The anode electrode 50 includes in it a plurality of cavity resonators. An output metallic sealing member 52 is a kind of a sleeve-like structure or a structure comprised of several cylinder portions in different diameters connected with each other, and it connects the output (antenna) insulator 54 hermetically to the anode electrode 50. Another antenna metallic sealing member 56 connects an exhausting tube 58 hermetically to the output insulator 54. The insulator 54 is made of ceramics for example. An antenna lead or conductor 60 has its one end connected to one of vanes 61 which constitute cavity resonators, and another end fixed by press-cutting to the exhausting tube 58. A metallic cap 62 serves to protect the above-mentioned press-cut portion and also finely adjust the antenna characteristics. Magnetic poles 64 and 66 provided at respective ends of the anode electrode 50 introduce the magnetism supplied by external permanent magnets 20 and 22 to provide a parallel magnetic field for an interaction space 68 where thermal ions move. Strap rings 70 comprised of two pairs of inner strap ring **70*a* and outer strap ring 70*b* are placed on the ends of the vanes which ends are in the axial direction of the cylindrical anode 50, and of the two pairs of inner strap rings 70*a* and outer strap rings 70*b* one pair is provided at the end of the vanes 61 on the side of output (antenna), while the other pair is provided at the end of the vanes 61 on the side of input (see FIG. 6). The two inner strap rings 70*a* make electrical connection for every second vane 61 as shown in FIG. 6, while the two outer strap rings 70*b* makes electrical connection for the remaining vanes. Each outer strap ring 70*b* is located at a portion further out than each inner strap ring 70*a*** with respect to the axis of the anode cylinder.

It has been a conventional practice to place these inner and outer strap rings as nearer to the anode axis as possible so as to achieve a better Q of magnetron and stable generation of microwave, whereas the inventive structure places the strap rings apart from the anode axis based on the finding that this scheme effectively suppresses harmonic components.

The embodiment will be described in more detail using FIGS. 4 to 6 extract only principal portions from FIG. 3.

Figure 4:
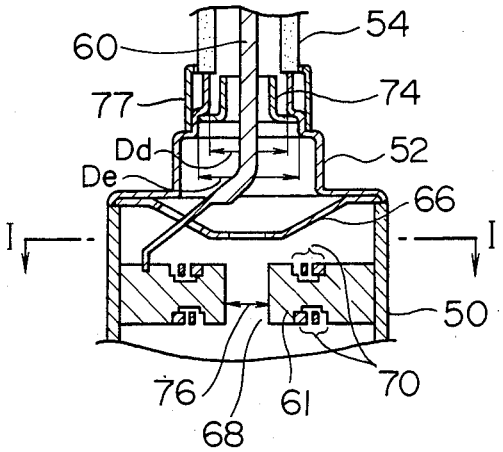
FIG. 4 is a longitudinal cross-section showing the primary portion and output section of the embodiment shown in FIG. 3.
Figure 7:
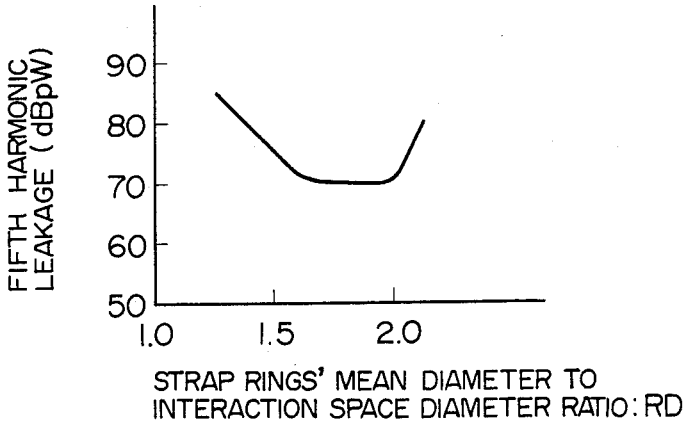
FIG. 7 is a graph showing the spurious microwave leakage in relation with the ratio of the mean diameter of the strap rings to the interaction space diameter.

In FIG. 4, a plurality of vanes 61 are placed in radial arrangement in the interior of the magnetron anode cylinder 50, and two sets of strap rings 70 (**70*a* and 70*b*) are fixed to the edges at the magnetron input and output sections of the vanes 61 so that reasonant cavities 72 are formed. One of the vanes 61 is connected with the antenna conductor 60, which passes through a hole in the magnetic pole piece 66 to the output section of the magnetron. The strap rings 70 are made up of the inner strap ring 70*a* and outer strap ring 70*b* as shown in FIG. 6. For the strap rings 70*a* and 70*b* having diameters Di and Dj, respectively, an experimental data shown in FIG. 7 reveals that the leakage of the fifth harmonic is most reduced when the algebraic mean diameter Da of the Di and Dj ($Da=(Di+Dj)/2$) ranges 1.75 to 1.95 times the diameter Db of the interaction space 68 defined by the tips of the vanes (i.e., inner diameter 76** of the vanes). The ratio of diameters ($RD=Da/Db=1.75$ to 1.95) is also effective for suppressing the leakage of the second through fourth harmonics.

A choke 74 in FIG. 4 is tuned to the frequency of the spurious microwave or harmonic to be prevented from leaking. The choke 74 has a metallic, cylindrical structure, and it is placed along the interior wall of the output metallic sealing member 52, with the antenna lead 60 running through the interior of the choke 74. The choke 74 has a flange at its one end, through which it is connected electrically to the anode cylinder 50. Another end of the choke 74 farther from the anode cylinder 50 is left open, and this section is located at virtually the same level as the opening of the sealing member 52.

Figure 8:
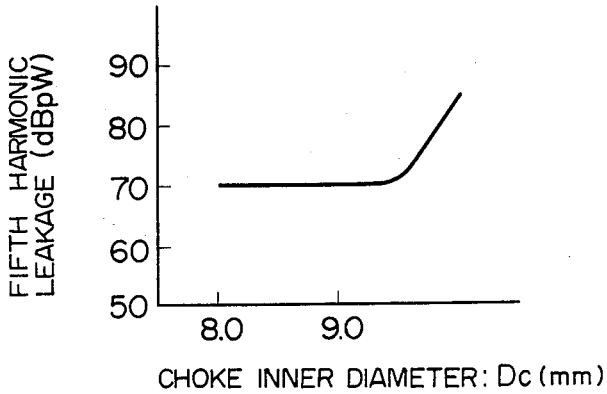
FIG. 8 is a graph showing the fifth harmonic leakage in relation with the choke inner diameter.

By the disposition of such a choke 74 having an inner diameter Dc ranging 8.0–9.0 mm and a length of cylindrical section Lc ranging 4.0–6.5 mm, the effect of fifth harmonic suppression as shown in FIG. 8 was proved. In this connection, the metallic seal 52 has an inner diameter Dd of about 14 mm at the position of the choke 74. The cylindrical length Lc of the choke 74 is theoretically equal to a quarter of the wavelength $\lambda$ of the microwave leaking through the space in the metallic seal 74, but practically it needs to be determined by experiment.

A great advantage of the embodiment of FIG. 4 is its leakage suppression effect against the fifth harmonic in such a wide range of length Lc as 4.0–6.5 mm of the cylindrical portion of the choke 74. This means, from another viewpoint, a wider frequency range in which the leakage suppression effect is exerted. According to the theory which gives $Lc=\lambda/4$, a 0.1 mm error of the length Lc will result in a deviation from the frequency effective for leakage suppression by approximately 200 MHz, and the need of such a high machining accuracy for the length Lc poses a problem in manufacturing. This problem may be resolved by reducing the inner diameter of the choke 74. However, this solution has a limitation because of possible problems such as arcing between the choke 74 and the antenna lead 60 caused by the microwave which is likely to occur when the inner diameter of the choke 74 is reduced and is positioned too closer to the antenna lead 60. The embodiment of this invention shown in FIG. 4 overcomes this problem by an additional choke 77 provided outside of the metallic seal 52 and in the vicinity of its opening located more apart from the anode cylinder 50. The additional choke 77 has a metallic, cylindrical structure, with its one end being in contact with the metallic seal 52 and another end located at virtually the same position as of the opening, farther from the anode cylinder 50, of the metallic seal 52. It is enough for the additional choke 77 to have its dimensions determined so that it is tuned to a frequency substantially equal to the intended frequency of leakage suppression.

More specifically, the reason why the above-mentioned problem is resolved by providing the additional choke 77 may be explained as follows, with reference to FIG. 5. FIG. 5 is a partial enlarged view of FIG. 4.

Figure 5:
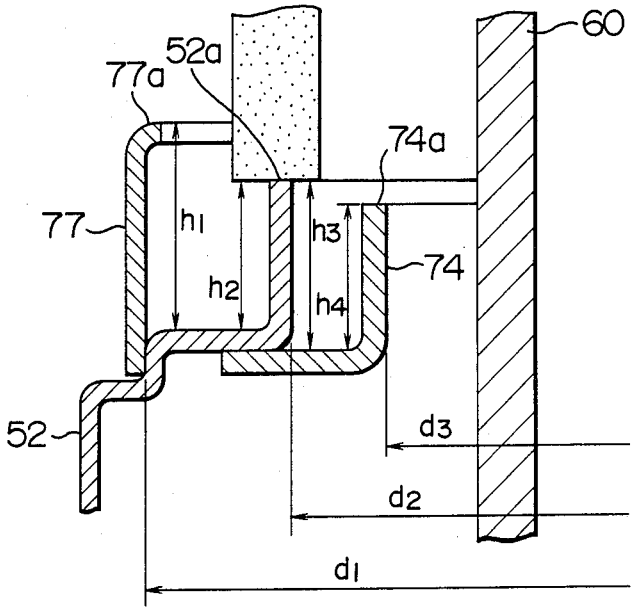
FIG. 5 is a partially enlarged view of FIG. 4.

As shown in FIG. 5, the choke 74 is provided inside of the metallic seal 52 and at the end thereof more remote from the anode cylinder 50 such that an open end 74*a* of the choke 74, a portion 52 connecting the metal seal 52 and the insulator 54 and an open end 77*a* of the choke 77 are substantially aligned. With this arrangement, since the space surrounded by the choke 74 and the metallic seal 52 and provided inside of the vacuum tube and the space surrounded by the choke 77 and the metallic seal 52 and provided outside have resonance frequencies which are close to one another, the leakage suppression effect is large in wide frequency range.

In particular, in the embodiment as shown in FIG. 5, $h_1$, $h_2$, $h_3$ and $h_4$ are, for example, 5.0 mm, 4.0 mm, 4.5 mm and 4.2 mm, respectively, (while, the diameters $d_1$, $d_2$ and $d_3$ are, for example, 19.0 mm, 14.5 mm and 9.0 mm mm, respectively). Thus, $h_2$ and $h_3$ are close to $\lambda/4$ of the fifth harmonic ($\simeq$6.1 mm in the free space). Because of this, as the inventors speculate, the leakage suppression effect is maintained high even if $h_4$ changes a great deal.

The metallic seal 52, at the section in contact with the opening section of the additional choke 77, has an inner diameter De of approximately 19 mm in the embodiment of FIG. 4. The thickness of the sheet for making the chokes 74 and 77 is 0.5 mm for example.

FIG. 8 shows the result of measurement of the fifth harmonic leakage. The graph is plotted against inner diameters Dc=8.0−9.5 mm of the choke 74 having a constant length Lc.

Figure 9:
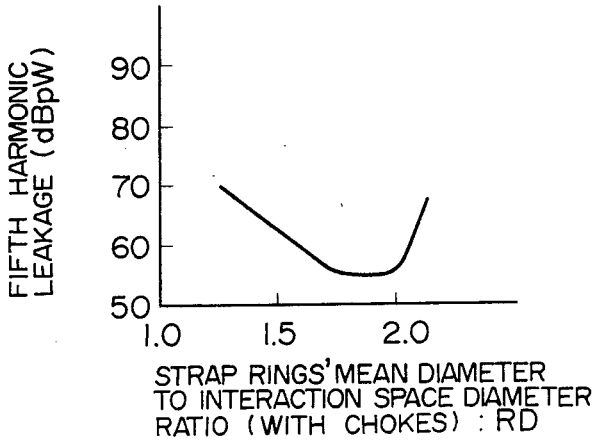
FIG. 9 is a graph showing a fifth harmonic leakage applicable to the case where the dimensional condition on the strap rings and vanes and the provision of chokes are combined.

When the above fifth harmonic leakage preventing chokes 74 and 77 are combined with the aforementioned structure with the dimensional condition on the strap rings 70 and vanes 61, a significant effect resulted as shown in FIG. 9, and this structure further reduced the harmonic leakage by about 25 dB as compared with the conventional structure.

The present invention achieves a significant reduction in the spurious harmonic leakage from the magnetron as compared with conventional ones, and it contributes to the upgrade of microwave cookers.

Although the present invention has been described for the case of a magnetron generating a 2.45 GHz microwave and the case of leakage suppression against the fifth harmonic, the specific values in the above description of the embodiment, e.g., dimensions of the chokes 74 and 77 and the metallic seal 52, are varied naturally depending on particular design condition, e.g., the fundamental frequency of the magnetron and the frequency of harmonic to be suppressed.

We claim:

1. A magnetron comprising:

a hermetically sealed anode electrode cylinder;

a plurality of vanes provided in a radial arrangement inside said anode electrode cylinder;

two pairs of inner and outer strap rings, each pair being fixed to said vanes at each end thereof in the axial direction of said anode electrode cylinder;

an antenna conductor connected to one of said vanes; and a metallic sealing member fixed hermetically to one end of said anode electrode cylinder, said antenna conductor extending to the outside through said metallic sealing member, wherein said inner and outer strap rings have diameters determined on the basis of a relation between an algebraic mean value of diameters of said inner and outer strap rings and an attenuation value of spurious microwave to be prevented from leaking, said algebraic mean value of diameters of said inner and outer strap rings being substantially 1.75 to 1.95 times the diameter of a space defined by the tips of said vanes in the radial direction of said anode electrode cylinder.

2. A magnetron according to claim 1 further comprising first choke means provided inside of said metallic seal member for suppressing the leakage of said spurious microwave.

3. A magnetron according to claim 2, wherein said first choke comprises a metallic cylinder with one end, nearer to said anode electrode cylinder, thereof being fixed to said metallic sealing member.

4. A magnetron according to claim 2 further comprising second choke means provided outside of said metallic sealing member for suppressing the leakage of said spurious microwave.

5. A magnetron according to claim 4, wherein said second choke comprises a metallic cylinder with one end, nearer to said anode electrode cylinder, thereof being fixed to said metallic sealing member.

6. A magnetron comprising:

a cylinder forming an anode electrode;

a plurality of vanes extending radially and inwardly from the inner wall of said anode electrode cylinder;

two pairs of inner and outer strap rings, said inner strap rings electrically connecting every second one of said vanes at the ends thereof in the axial direction of said anode electrode cylinder, said outer strap rings electrically connecting remaining ones of said vanes at the ends thereof in the axial direction of said anode electrode cylinder, said outer strap rings being located at a position further out than said inner strap rings with respect to the axis of said anode electrode cylinder;

a cathode filament having a lead-out wire and disposed substantially at the center of said anode electrode cylinder, an interaction space formed by a d.c. electric field produced between said anode electrode and said cathode filament and a magnetic field intersecting at right angles with said electric field being defined by the edges of said vanes in the radial direction of said anode cylinder;

magnetic members provided at both ends of said anode cylinder and adapted to introduce an external magnetic field into said interaction space so as to establish said intersection magnetic field;

a conductor having one end connected to one of said vanes to lead out a generated microwave;

a metallic sleeve-like structure having a pair of openings, one of said openings being fixed to said anode cylinder at the end thereof where said conductor is provided, the other opening serving to lead out said conductor to the outside, said conductor extending in a certain length from said other opening of said structure;

first sealing means of insulation material for sealing said other opening of said sleeve-like structure inclusive of said conductor, a microwave output being emitted to the outside from a section of said conductor located inside of said first sealing means; and second sealing means for sealing hermetically said anode cylinder inclusive of said lead-out wire at the end of said anode cylinder where said lead-out wire is provided, said inner and outer strap rings having diameters determined on the basis of a relation between an algebraic mean of diameters of said inner and outer strap rings and an attenuation value of a spurious microwave to be prevented from leaking, said inner and outer strap rings have diameters determined such that the algebraic mean of diameters of said inner and outer strap rings is substantially 1.75 to 1.95 times the diameter of said interaction space.

7. A magnetron according to claim 6 further comprising choke means which is substantially tuned to a frequency of a spurious microwave to be prevented from leaking so as to suppress the leakage of said spurious microwave, said choke means being disposed inside of said sleeve-like structure and in close vicinity to said first-mentioned opening.

8. A magnetron according to claim 7, wherein said choke means comprises a metallic cylinder with a length virtually equal to a quarter of wavelength of said spurious microwave, said cylinder being disposed along the inner wall of said sleeve-like structure with said conductor running in said cylinder, said metallic cylinder having one end, nearer to said anode cylinder, connected electrically to said sleeve-like structure and another end forming an opening located at virtually the same position as said other opening of said sleeve-like structure.

9. A magnetron according to claim 8, wherein said metallic cylinder is dimensioned to have an inner diameter of 8.0 to 9.5 mm and a length of 4.0 to 6.5 mm.

10. A magnetron according to claim 9, wherein said sleeve-like structure is dimensioned to have an inner diameter of about 14 mm at a portion where said metallic cylinder is located.

11. A magnetron according to claim 7 further comprising additional choke means located outside of said sleeve-like structure and in close vicinity to said first-mentioned opening, said additional choke means being substantially tuned to a frequency of said spurious microwave.

12. A magnetron according to claim 11, wherein said choke means comprises a metallic cylinder with a length virtually equal to a quarter of wavelength of said spurious microwave, said metallic cylinder being disposed along the inner wall of said sleeve-like structure with said conductor running in said cylinder, said metallic cylinder having one end, nearer to said anode cylinder, connected electrically to said sleeve-like structure and another end forming an opening located at virtually the same position as said other opening of said sleeve-like structure.

13. A magnetron according to claim 11, wherein said additional choke means comprises an additional metallic cylinder with a length virtually equal to a quarter of wavelength of said spurious microwave, said additional metallic cylinder being disposed outside of said sleeve-like structure, with one end, nearer to said anode cylinder, of said additional cylinder being in electrical connection with said sleeve-like structure and another end having an opening located at substantially the same position as said other opening of said sleeve-like structure.

* * * * *